US006939241B1

(12) United States Patent
Chang

(10) Patent No.: US 6,939,241 B1
(45) Date of Patent: Sep. 6, 2005

(54) QUICK CHIPPING SET

(76) Inventor: Wen I Chang, 235 P.O. Box 10-69 Chung-Ho, Taipei (TW)

( * ) Notice: Subject to any disclaimer, the term of this patent is extended or adjusted under 35 U.S.C. 154(b) by 0 days.

(21) Appl. No.: 10/827,222

(22) Filed: Apr. 20, 2004

(51) Int. Cl.[7] ..... A63B 69/36
(52) U.S. Cl. ..... 473/197; 273/400
(58) Field of Search ..... 473/476, 478, 473/398–402

(56) References Cited

U.S. PATENT DOCUMENTS 3,115,340 A * 12/1963 Stasiuk ..... 473/414
4,336,942 A * 6/1982 Warehime ..... 473/470
5,163,461 A * 11/1992 Ivanovich et al. ..... 135/126
5,427,381 A * 6/1995 Macaluso et al. ..... 273/400
5,569,094 A * 10/1996 Macaluso ..... 473/197
6,312,343 B1 * 11/2001 Cho ..... 473/197
6,352,480 B1 * 3/2002 Macaluso ..... 473/197
6,514,149 B2 * 2/2003 Yoon ..... 473/197
6,517,444 B1 * 2/2003 Yoon ..... 473/197
6,607,455 B1 * 8/2003 Petras ..... 473/478
2001/0034271 A1 * 10/2001 Nozato ..... 473/197
2003/0181264 A1 * 9/2003 Yoon ..... 473/421

* cited by examiner

*Primary Examiner*—Mark S. Graham

(57) ABSTRACT

A quick chipping net comprises a first flexible ring having a first buckle at one end thereof; a second flexible ring pivotally connected to another end of the first flexible ring so that the first flexible ring is turnable on the second flexible ring; and a third flexible ring having a receiving net; the receiving net being formed as a concave cambered shape for receiving a golf ball; one end of the third flexible ring being pivotally connected to the second flexible ring so that the third flexible ring is turnable on the second flexible ring; the third flexible ring having a second buckle. Furthermore, a plurality of cloth fasteners are formed on an edge of the third flexible ring for installing a target net; and the target net serves to indicate a falling position of a golf ball.

6 Claims, 10 Drawing Sheets

QUICK CHIPPING SET

FIELD OF THE INVENTION

The present invention relates to quick chipping nets, and particular to a quick chipping net which has a steady and firm structure and the quick chipping net includes a target net so as to indicate the area of an incident golf ball.

BACKGROUND OF THE INVENTION

With reference to FIG. 1, the prior art quick chipping net is shown. The quick chipping net has a net fame A. The net fame A is combined to a net body B. A lower end of the net fame A is connected to one end of a bottom frame C and another end thereof is connected to another end of the bottom frame C through a supporting rod D so that the net fame A is inclined for receiving a golf ball. However, since the net fame A, supporting rod D, and bottom frame C are made of hard material, the prior art cannot be received easily. When the supporting rod D, net fame A and bottom frame C are assembled separately, not integrally, once the supporting rod D is lost, the net fame A and bottom frame C cannot work.

Referring to FIGS. 2 and 2-1, another prior art quick chipping net is illustrated. The quick chipping net includes a first ring E and a second ring F. An area of the first ring E is larger than the second ring F and the first ring E is made of flexible material. The second ring F is made of hard material. The second ring F is combined with a net body G. The tops of the first ring E and second ring F are combined, while the first ring E and second ring F are expandable. In use, the bottoms of the first ring E and second ring F are expanded so as to form a V shape. Two sides of the first ring E are tied by a rope H or a strip of cloth so that the two sides of the first ring E are extruded to compress inwards as a supporter. Thereby, the second ring F is supported so that the net body of the second ring F can receive a golf ball. However, since the second ring F is only supported by the first ring E, the second ring F is unstable in receiving a golf ball. It is possible that the net body G falls into the receiving golf ball. The second ring F is made of hard material so as to have a large area in storage and thus the storage of the quick chipping net is inconvenient.

SUMMARY OF THE INVENTION

Accordingly, the primary object of the present invention is to provide a quick chipping net. The quick chipping net comprises a first flexible ring having a first buckle at one end thereof; a second flexible ring pivotally connected to another end of the first flexible ring so that the first flexible ring is turnable on the second flexible ring; and a third flexible ring having a receiving net; the receiving net being formed as a concave cambered shape for receiving a golf ball; one end of the third flexible ring being pivotally connected to the second flexible ring so that the third flexible ring is turnable on the second flexible ring; the third flexible ring having a second buckle. Furthermore, a plurality of cloth fasteners are formed on an edge of the third flexible ring for installing a target net; and the target net serves to indicate a falling position of a golf ball.

Furthermore, the quick chipping net as claimed in claim 6, wherein the target net comprises a first net body, a second net body enclosed by and isolated from the first net body; an area of the second net body being smaller than that of the first net body; a third net body enclosed by and isolated from the second net body; an area of the third net body being smaller than that of the second net body; and four isolating nets; each isolating net having one end connected to one corner of the first net body and passing through the second net body and third net body to a respective cloth fastener; and thus, the target net being divided into nine sections.

The various objects and advantages of the present invention will be more readily understood from the following detailed description when read in conjunction with the appended drawing.

BRIEF DESCRIPTION OF THE DRAWINGS

FIGS. 2 and 2-1 are schematic views of prior art quick chipping net.

FIGS. 4, 4-1(*a*) and 4-1(*b*) are schematic views showing the storage of the quick chipping net of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 3:
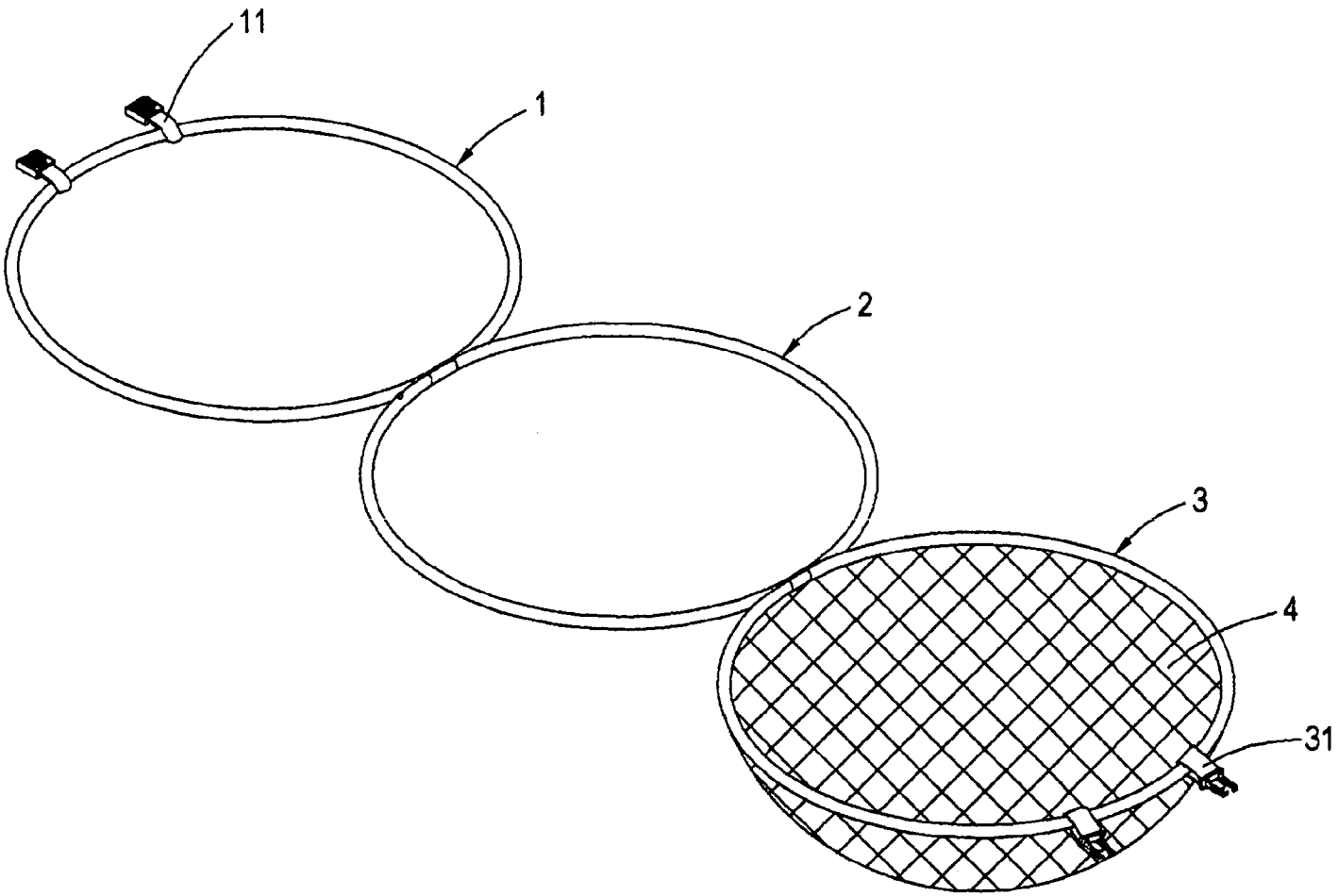
FIG. 3 is an expanded view of the quick chipping net of the present invention.

Referring to FIG. 3, the quick chipping net of the present invention is illustrated. The quick chipping net includes the following elements.

A first flexible ring 1 has a female buckle 11 at one end thereof.

A second flexible ring 2 is pivotally connected to another end of the first flexible ring 1 so that the first flexible ring 1 is turnable on the second flexible ring 2.

A third flexible ring 3 has a receiving net 4. The receiving net 4 is formed as a concave cambered shape for receiving a golf ball. One end of the third flexible ring 3 is pivotally connected to the second flexible ring 2 so that the third flexible ring 3 is turnable on the second flexible ring 2. Thus the second flexible ring 2 is installed between the first flexible ring 1 and the second flexible ring 2. The third flexible ring 3 is a male buckle 31.

In another embodiment of the present invention, the first flexible ring 1 has a male buckle and the third flexible ring 3 has a female buckle 11.

Figure 1:
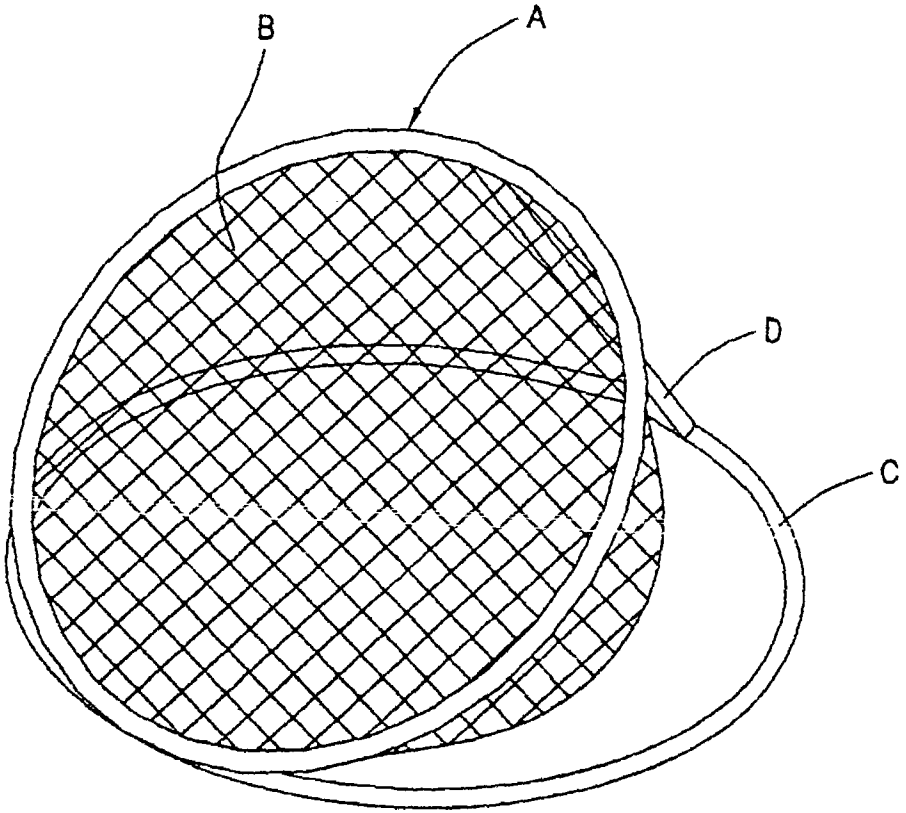
Fig. 1 (PRIOR ART)
FIG. 1 is a schematic view of a prior art golf ball.
Figure 2:
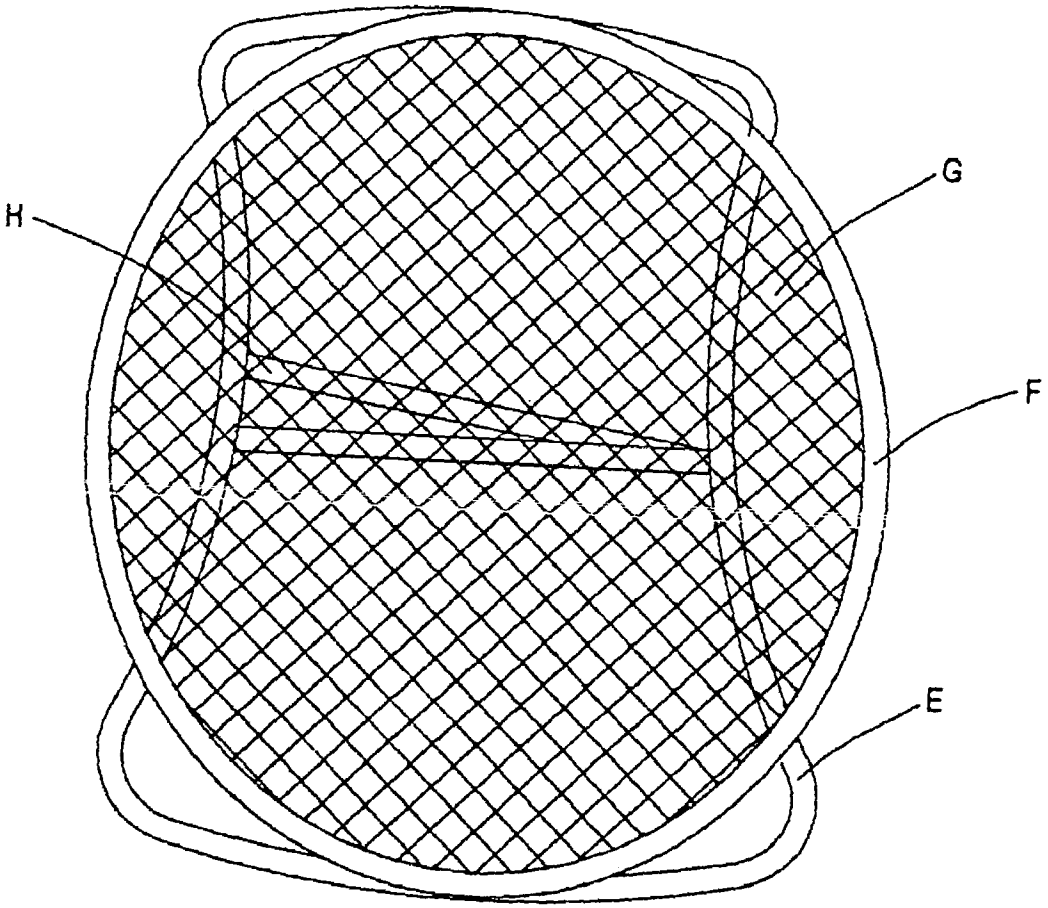
Fig. 2 (PRIOR ART)
Figures 1, 2:
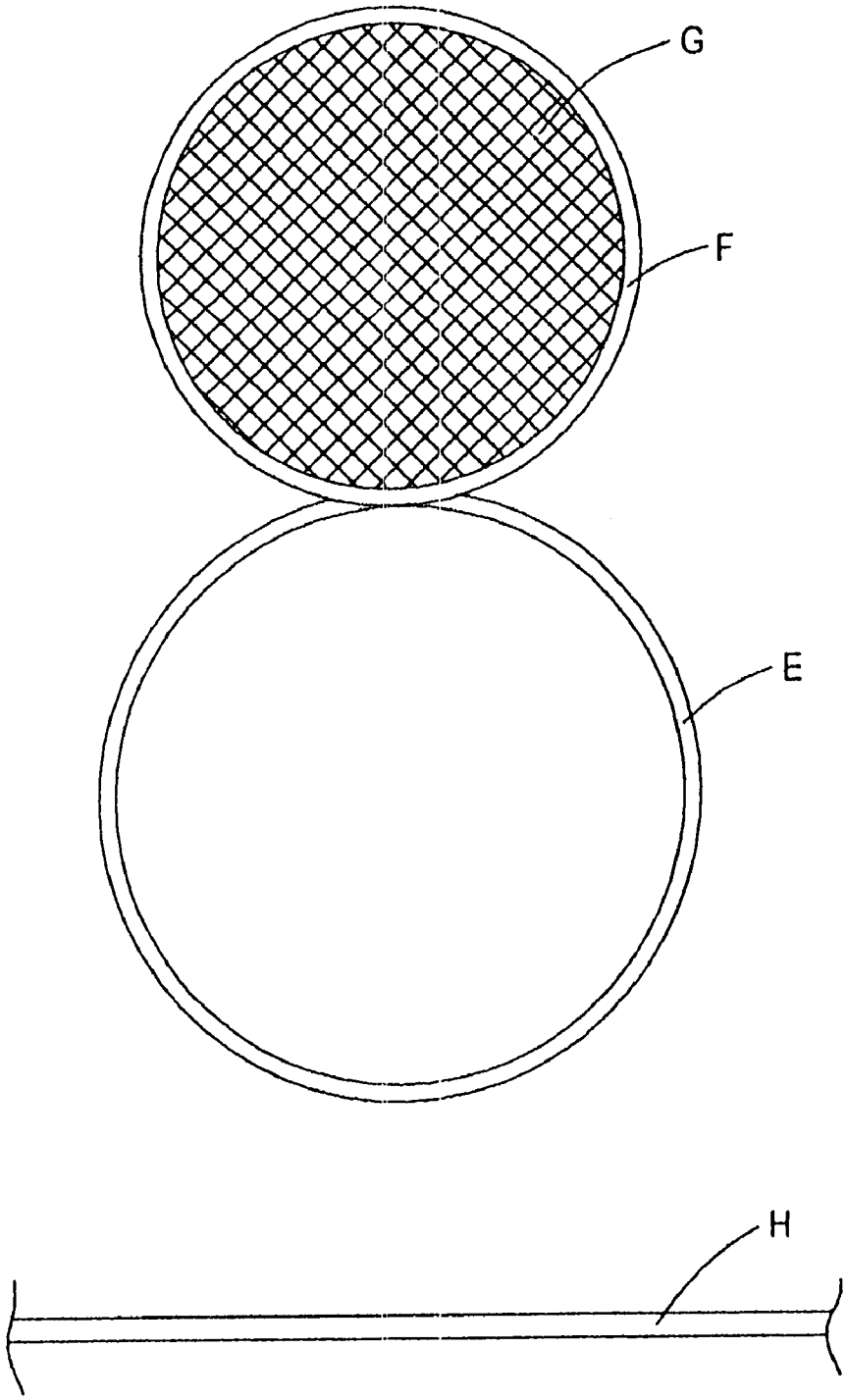
Fig. 2-1 (PRIOR ART)
Figure 4:
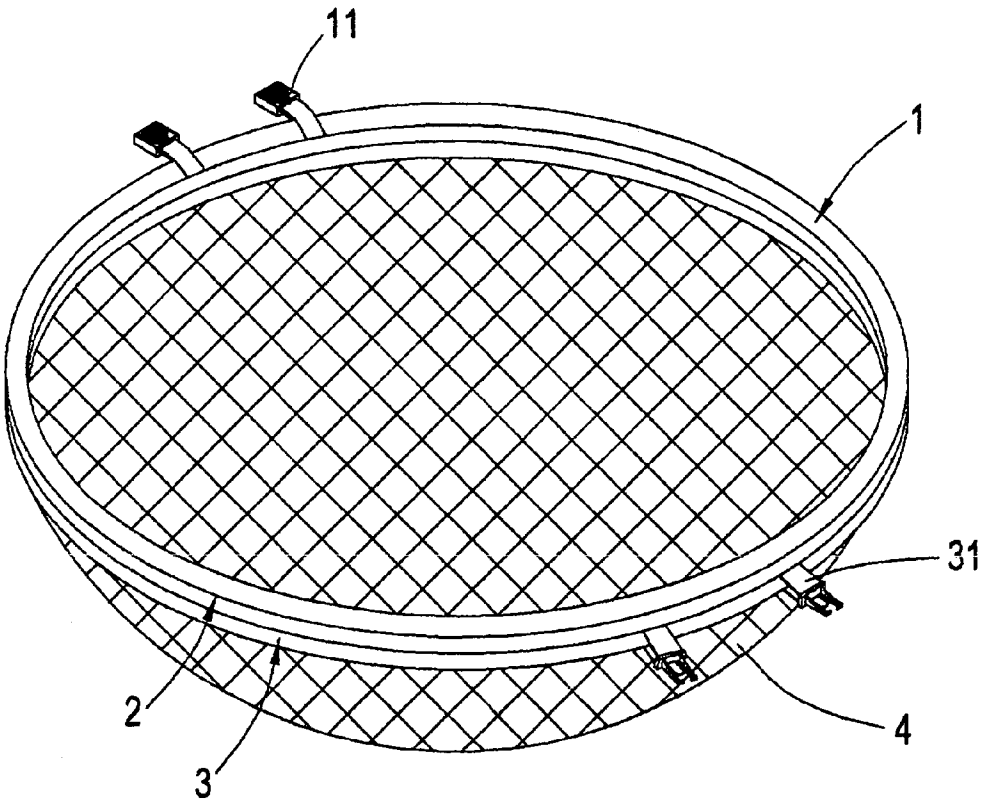
Figures 1, 4:
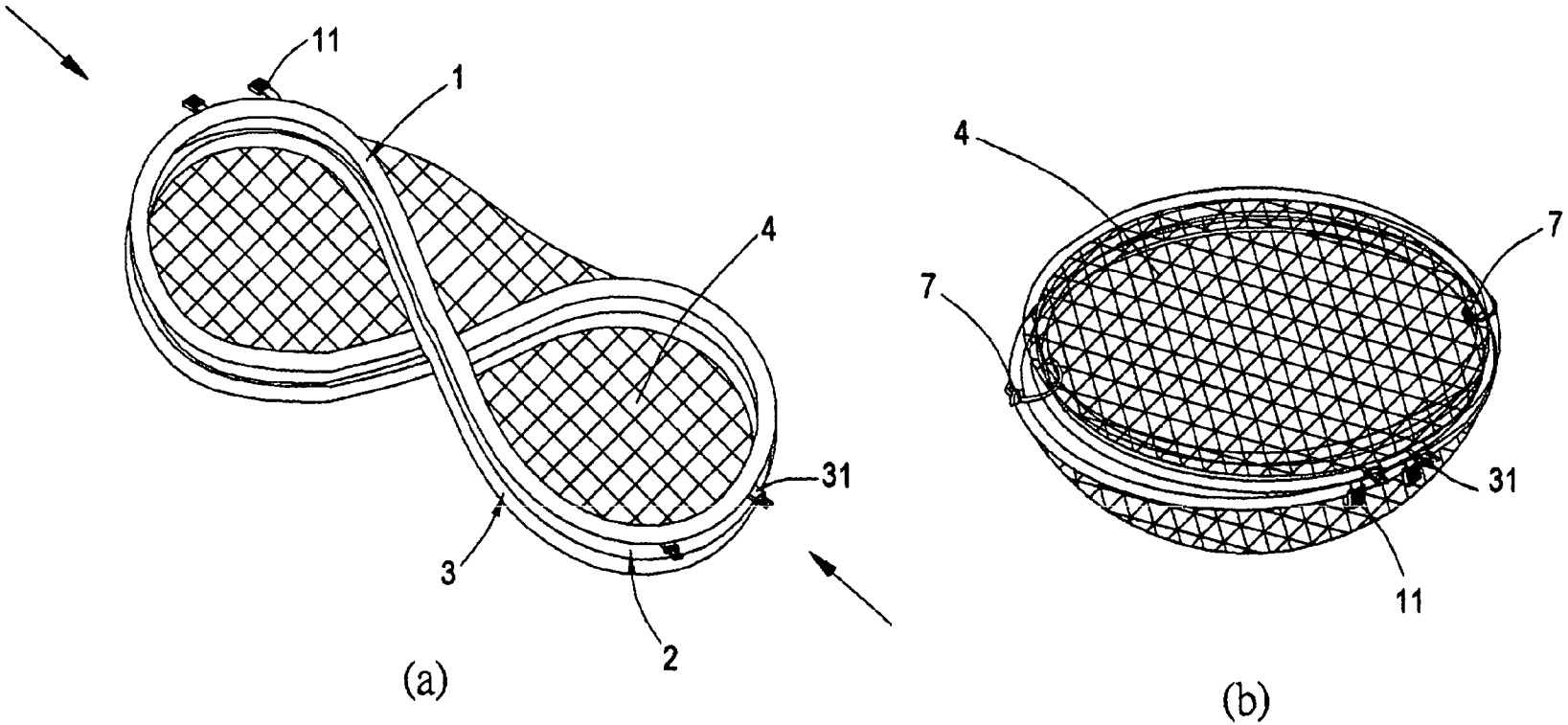

Further referring to FIGS. 4, and 4-1, a schematic view showing the way for storing the present invention is illustrated. Firstly, the first flexible ring 1, second flexible ring 2 and third flexible ring 3 are overlapped as a ring body. Then the overlapped first flexible ring 1, second flexible ring 2 and third flexible ring 3 are twisted to have a shape like "8", namely there are two small circles, see FIG. 4-1(*a*). Then the two small circles are overlapped as one ring, see FIG. 4-1(*b*). Then the female buckle 11 of the first flexible ring 1 and the male buckle 31 of the third flexible ring 3 are buckled. Then a rope 7 serves to tie the rings. Thereby, the twisted rings will not restore to the original shapes so that the quick chipping net of the present invention can be stored easily.

Figure 5:
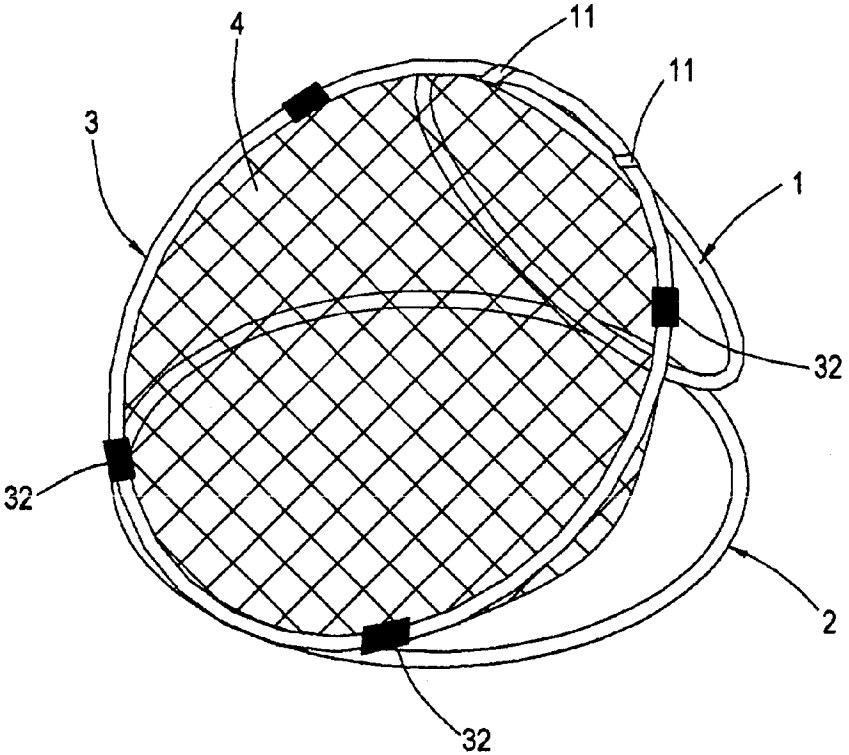
FIG. 5 is a schematic view showing the use of the present invention.

With reference to FIG. 5, a schematic view showing the use of the present invention is illustrated. In use, the second flexible ring 2 is placed on a ground so as to form as a seat. The second flexible ring 2 and third flexible ring 3 are turned upwards to be tilted so that the first flexible ring 1 resists against one end portion of the third flexible ring 3. Namely, the third flexible ring 3 is supported by the first flexible ring 1. Thus, the first flexible ring 1, second flexible ring 2 and third flexible ring 3 are formed as a triangular. The female buckle 11 of the first flexible ring 1 is buckled to the male buckle 31 of the third flexible ring 3. Thereby, the first flexible ring 1 steadily supports the third flexible ring 3. By the flexibility of the first flexible ring 1, a buffer is generated. Since the first flexible ring 1, second flexible ring 2 and third flexible ring 3 are formed as a triangular, the third flexible ring 3 can suffer from the impact force of an incident golf ball.

Figure 6:
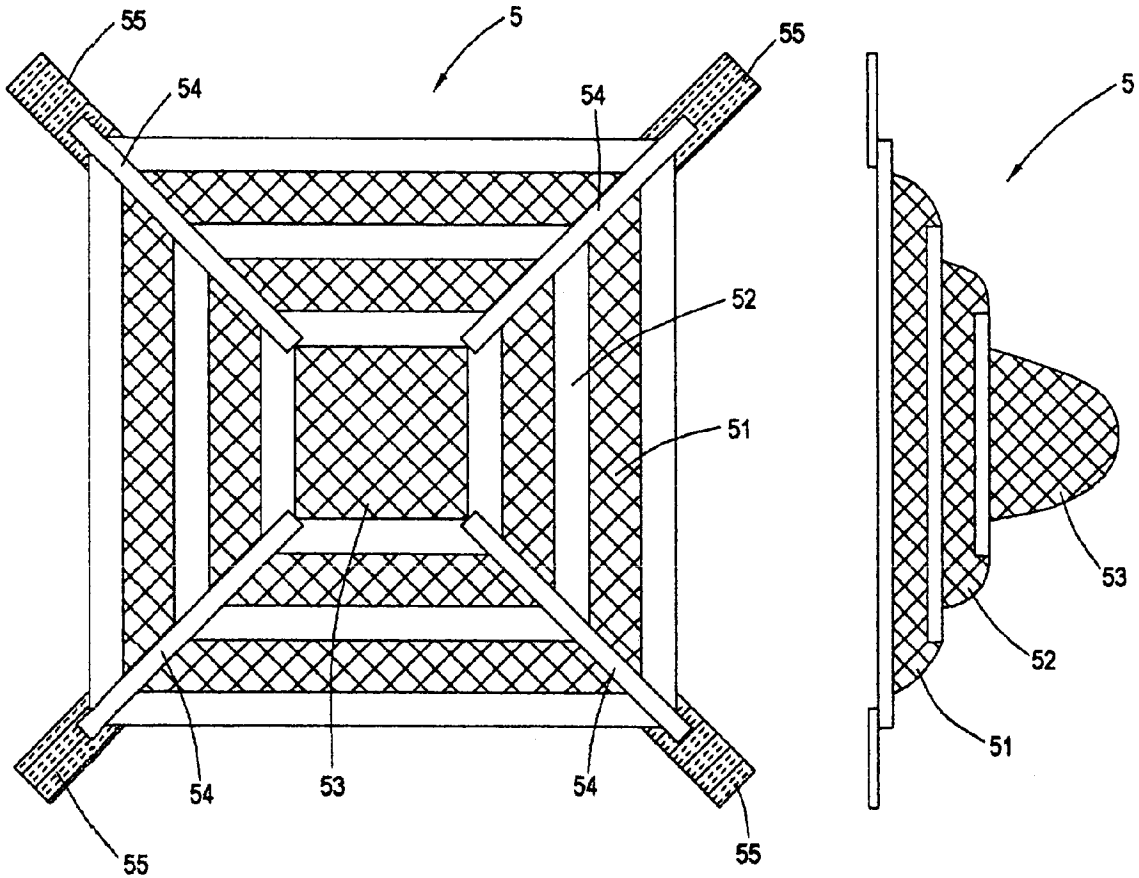
FIG. 6 is a schematic view showing the target net of the present invention.
Figure 7:
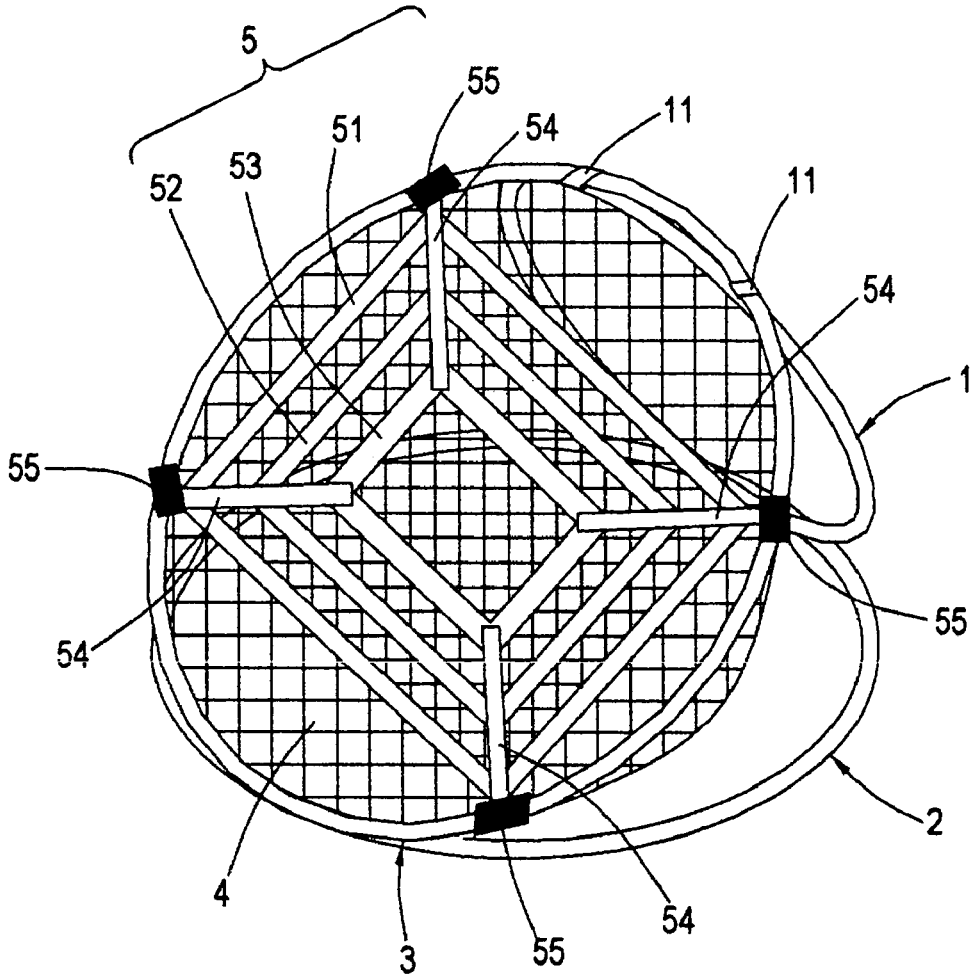
FIG. 7 shows another embodiment of the quick chipping net of the present invention.

Furthermore, a periphery of the third flexible ring 3 is installed with a plurality of cloth fasteners 32 which are spaced with an equal space. The cloth fasteners (32 in FIG. 5, and 55 in FIGS. 6 and 7) serve to combine a target net 5, as shown in FIGS. 6 and 7.

The target net 5 comprises the following elements.

A first net body 51 is include.

A second net body 52 is enclosed by and isolated from the first net body 51. An area of the second net body 52 is smaller than that of the first net body 51.

A third net body 53 is enclosed by and isolated from the second net body 52. An area of the third net body 53 is smaller than that of the second net body 52.

Four isolating nets 54 are included. Each isolating net 54 has one end connected to one corner of the first net body 51 and passing through the second net body 52 and third net body 53 to a respective cloth fastener 55. Thus, the target net 5 is divided into nine sections.

Figure 8:
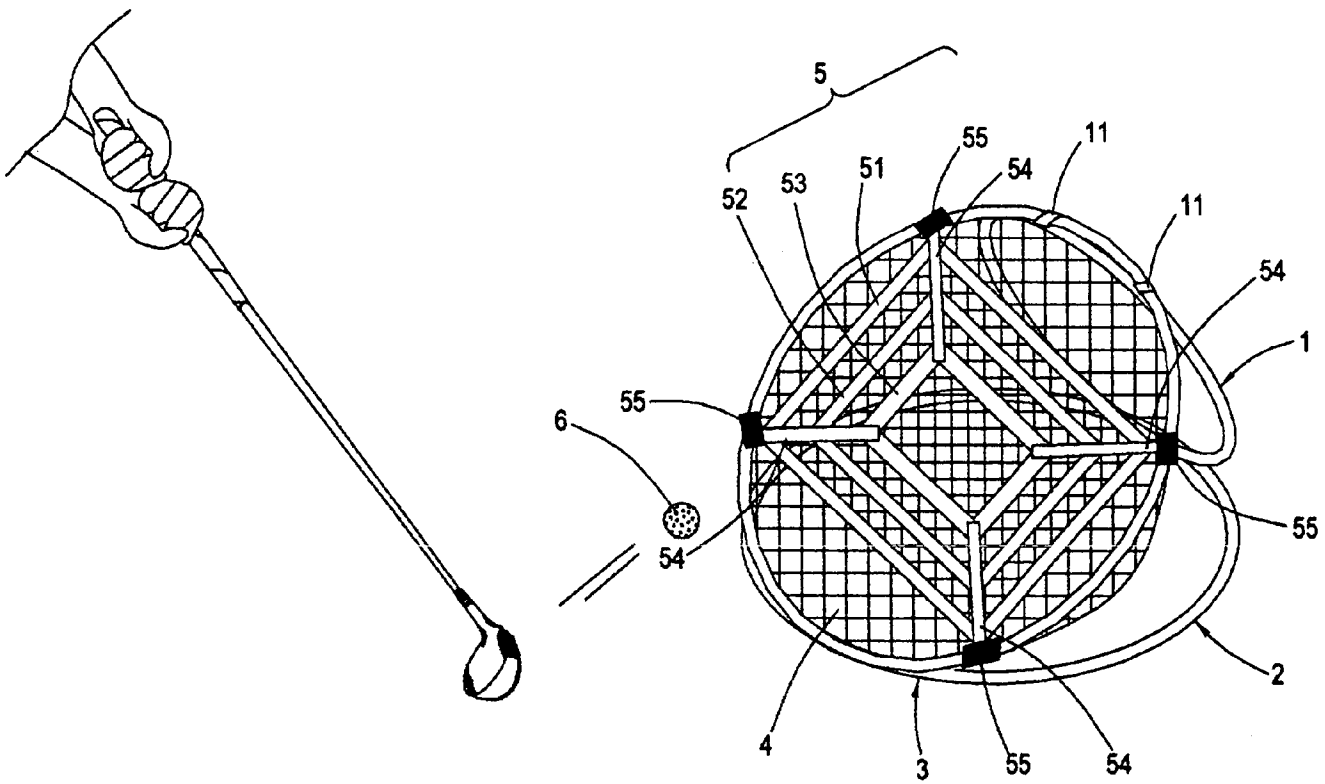
FIG. 8 shows the use of the present invention, where the target net is installed.

Viewing from a lateral side of the target net 5, the target net 5 can have a ladder shape, as illustrated in FIG. 6. From the nine sections, the area receiving a golf ball 6 can be seen clearly, as shown in FIG. 8. Thereby, the score can be calculated from the area receiving the golf ball 6.

Advantages of the present invention will be described herein. In the present invention, the first flexible ring 1, second flexible ring 2 and third flexible ring 3 are flexible so that they can be twisted to have a circle of smaller area. Therefore, it can be stored easily. Furthermore, the first flexible ring 1, second flexible ring 2 and third flexible ring 3 are supported by each other so that it has a firm structure as used for receiving a golf ball 6. The third flexible ring 3 can be stuck with a target net 5 to point the area receiving a golf ball 6.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A quick chipping net comprising:

a first flexible ring having a first buckle at one end thereof;

a second flexible ring pivotally connected to another end of the first flexible ring so that the first flexible ring is turnable on the second flexible ring;

a third flexible ring having a receiving net; the receiving net being formed as a concave cambered shape for receiving a golf ball; one end of the third flexible ring being pivotally connected to the second flexible ring so that the third flexible ring is turnable on the second flexible ring; the third flexible ring having a second buckle.

2. The quick chipping net as claimed in claim 1, wherein the first buckle is a female buckle and the second buckle is a male buckle.

3. The quick chipping net as claimed in claim 1, wherein the first buckle is a male buckle and the second buckle is a female buckle.

4. The quick chipping net as claimed in claim 1, wherein the third flexible ring, second flexible ring and third flexible ring are overlapped as a stacking ring and then the stacking ring is twisted to have two smaller circles; and then the two small circles are overlapped as a circle, and then the first and second buckles are buckled.

5. The quick chipping net as claimed in claim 1, wherein a plurality of cloth fasteners are formed on an edge of the third flexible ring for installing a target net; the target net serves to indicate a falling position of a golf ball.

6. The quick chipping net as claimed in claim 5, wherein the target net comprises:

a first net body;

a second net body enclosed by and isolated from the first net body; an area of the second net body being smaller than that of the first net body;

a third net body enclosed by and isolated from the second net body; an area of the third net body being smaller than that of the second net body; and four isolating nets; each isolating net having one end connected to one corner of the first net body and passing through the second net body and third net body to a respective cloth fastener on the third flexible ring; and thus, the target net being divided into nine sections.

* * * * *